US005227753A

United States Patent [19]

Hirai et al.

[11] Patent Number: 5,227,753

[45] Date of Patent: Jul. 13, 1993

[54] ELECTRON BEAM ADJUSTING DEVICE

[75] Inventors: Masatoshi Hirai; Shigeo Nishida, both of Mooka, Japan

[73] Assignee: Kanegafuchi Kagaku Kogyo Kabushiki Kaisha, Osaka, Japan

[21] Appl. No.: 802,670

[22] Filed: Dec. 5, 1991

[51] Int. Cl.[5] ..... H01F 1/00; H01J 29/70

[52] U.S. Cl. ..... 335/212; 313/431

[58] Field of Search ..... 335/210, 211, 212; 313/427, 428, 431, 440

[56] References Cited

U.S. PATENT DOCUMENTS 4,030,126 6/1977 Puhak ..... 358/248
4,091,347 5/1978 Barbin ..... 335/212
4,670,726 6/1987 Ogata et al. ..... 335/212

*Primary Examiner*—Leo P. Picard

*Assistant Examiner*—Raymond Barrera

*Attorney, Agent, or Firm*—Armstrong, Westerman, Hattori, McLeland & Naughton

[57] ABSTRACT

An electron beam adjusting device used in a cathode-ray tube (CRT) of a television receiver, a display, etc., which is improved in the adjusting accuracy, reduced in the overall size and thickness, and also improved in the degree of freedom with which it is attached to the neck of a CRT. The electron beam adjusting device has pairs of two-, four- and six-pole ring magnets, which are attached around the neck of a cathode-ray tube used in a television receiver, a display, etc. The two-pole magnets, which are required to have a relatively high level of magnetic force, and the four- and six-pole ring magnets, which are not required to have a high level of magnetic force, are different in thickness from each other.

2 Claims, 4 Drawing Sheets

ELECTRON BEAM ADJUSTING DEVICE

BACKGROUND OF THE INVENTION

1. Field of the Invention

The present invention relates to an electron beam adjusting device for use in cathode-ray tubes (CRTs) of television receivers, displays, etc. More particularly, the present invention relates to an electron beam adjusting device which is improved in the accuracy of adjustment made thereby, reduced in size and thickness, and also improved in the degree of freedom with which it is attached around the neck of a CRT.

2. Description of the Prior Art

Referring first to FIGS. 6, and 7, a typical conventional electron beam adjusting device comprises a magnet assembly formed by combining together ring magnets 1*a*, 1*a'*, 1*b*, 1*b'*, 1*c* and 1*c'* and spacers 2*a*, 2*b* and 2*c*, a cylindrical holder 3 made of a resin material, to which the magnet assembly is attached, and a metallic band screw 4 and a lock ring 5, which are used to secure the magnet assembly to the neck of a cathode-ray tube (CRT). It has heretofore been common practice to use as the ring magnets bonded magnets (resin-bonded magnets) each having a thickness of 1.2 to 1.6 mm and as the spacers those which are made of a resin material and have a thickess of 1 to 3 mm and a part of which has a spring mechanism. In the commonest type of electron beam adjusting device, the thickness d1 of the magnet assembly comprising the magnets and the spacers is 15 mm, and the overall thickness d2 of the adjusting device, including the holder 3, is 25 mm or more, although it somewhat varies according to the basic structure. It is common for the type of electron beam adjusting device with a lock mechanism to have a larger thickness than the above.

The ring magnets include two-, four- and six-pole magnets each having a thickness of 1.2 to 1.6 mm, which are formed by injection molding as moldings with the same thickness and thereafter magnetized such that the inner peripheral surfaces of the moldings have two, four and six magnetic poles, respectively. The magnet assembly comprises pairs of two-, four- and six-pole magnets 1*a*, 1*a'*, 1*b*, 1*b'*, 1*c* and 1*c'*, which are attached to a predetermined holder 3 with spacers 2*a*, 2*b* and 2*c* interposed between the pairs of magnets, respectively, thereby forming an electron beam adjusting device. The functions of the pairs of magnets in the electron beam adjusting device are as follows: The pair of two-pole magnets converges each of the three beams to the center of the fluorescent screen; the pair of four-pole magnets superposes two side beams one upon the other; and the pair of six-pole magnets superposes the two side beams superposed by the four-pole magnets upon the center beam. Each pair of magnets is used in such a manner that, after the magnets are rotated in opposite directions to adjust the magnetic force to a necessary level, the two magnets are rotated together in the same direction for adjustment. The intensity of magnetic force of each pair of magnets determines the amount of shift of the beam, that is, the maximum adjusting width. The minimum amount of beam shift, that is, the adjusting accuracy, is determined by the uniformity of magnetic fields in the two-pole magnets and by magnetic force variations between the poles of each magnet in the four- and six-pole magnets. In electron beam adjusting devices used in high-precision CRTs for displays or the like, it is particularly essential to reduce interpole magnetic force variations in the four- and six-pole magnets to thereby reduce the minimum amount of beam shift and thus improve the adjusting accuracy.

Incidentally, in order to ensure the required magnetic force intensity and uniformity of magnetic fields in two-pole magnets, which are the most difficult to ensure the magnetic force intensity, the thickness of the two-pole magnets must be increased to a certain extent. However, in the prior art wherein all the two-, four- and six-pole magnets have the same thickness, if the thickness of the two-pole magnets is increased, the thicknesses of the four-and six-pole magnets are also increased, as a matter of course. Since the four- and six-pole magnets need not so strong magnetic force as the two-pole magnets do but can exhibit the required functions with a relatively low level of magnetic force, when all the magnets have the same thickness, the amount of magnetization of the four- and six-pole magnets needs to be held down below that for the two-pole magnets. However, it is difficult to control the amount of magnetization to a relatively low level because bonded magnets, which are molded out of a magnetic material, unavoidably involve variations in the magnetic properties of the material, variations in the dimension and density of the moldings, variations in the magnetizing voltages, etc. This difficulty in contol causes variations in the amount of magnetization between the poles. Particularly, when there are large variations in the initial magnetization characteristics due to the powdered magnetic material and a large play between the inner peripheries of the moldings and the magnetizing yoke, it is practically difficult to stabilize the amount of magnetization at a relatively low level while adjusting these variations with the magnetizing voltage.

In addition, when the magnets are thick, it is also necessary to minimize aberration by providing a magnetic force difference between magnets which pair with each other, depending upon the CRT structure, so that the magnetization adjustment is complicated, which causes an increase in the interpole magnetic force variations.

Further, considering the attachment of an electron beam adjusting device to the neck of a CRT, together with adjusting characteristics and costs, it is extremely important to ensure the degree of freedom with which the electron beam adjusting device is mounted in position and to reduce the weight. Accordingly, the magnets become more favorable as the thickness and weight thereof decrease, as long as it is possible to ensure the strength required during adjustment, that is, the breaking strength of a portion of each magnet which is pinched to make adjustment. However, in the case of magnet moldings which have heretofore been used, when the thickness of the moldings is 1.0 mm or less, the flame retardance of the composition and the strength of the magnet moldings lower markedly. For this reason, the thickness of the moldings cannot be reduced to 1.0 mm or less in the present state of art.

BRIEF SUMMARY OF THE INVENTION

In view of the above-described circumstances, it is an object of the present invention to provide a thin electron beam adjusting device which is designed so that the magnetic forces of magnets are stabilized as much as possible even at a low level by making a difference in thickness between two-pole magnets, which are required to have a relatively high level of magnetic force, and four- and six-pole magnets, which are not required to have a high level of magnetic force, thereby improving the adjusting accuracy, and spacers and other constituent elements are also reduced in thickness as much as possible to thereby reduce the overall thickness of the device and eliminate the need for a complicated measure to minimize aberration, for example, provision of a magnetic force difference between each pair of magnets.

FIG. 1 is a graph showing the relationship between the amount of magnetization and the magnetizing voltage for each value of the thickness of ring magnets. Among the curves, the solid line curve and the one-dot chain line curve each show a trend of magnetization of four- or six-pole magnets. The solid line curve shows the trend of magnetization of magnets with a thickness of 1.5 mm, while the one-dot chain line curve shows that of magnets with a thickness of 0.8 mm. The dashed line curve shows a trend of magnetization of two-pole magnets with a thickness of 1.5 mm, while the two-dot chain line curve shows that of two-pole magnets with a thickness of 1.2 mm. The arrows put at the left end of the graph exemplarily show magnetic flux density ranges required for two-, four- and six-pole magnets, respectively. For example, two-pole magnets need an amount of magnetization in the range of from about 5 G to 6.5 G, whereas four-pole magnets need an amount of magnetization in the range of from about 1 G to 2 G, and six-pole magnets in the range of from about 2.5 G to 4 G.

As will be understood from the graph, when moldings with the same thickness, e.g., 1.5 mm, are employed as constituent magnets, the trend of magnetization of the four-and six-pole magnets is such as that shown by the solid line curve, which rises steeply with the rise in the magnetizing voltage. Accordingly, the four- and six-pole magnets, which are not required to have a high-level of magnetic force, must use a region where the dependence of the amount of magnetization on the magnetizing voltage is relatively high. There is therefore a high probability that the amount of magnetization will vary when there are variations in the magnetizing conditions due to an increase in the resistance caused by a rise in temperature of the magnetizing yoke, fluctuations in the supply voltage and so forth.

In contrast, when magnets with a thickness of 0.8 mm are employed, the trend of magnetization of the four- and six-pole magnets is such as that shown by the one-dot chain line curve, which rises gradually with the rise in the magnetizing voltage. It is therefore possible to lower the dependence of the amount of magnetization on the magnetizing voltage and hence possible to suppress the effect of fluctuations in the magnetizing voltage on the amount of magnetization.

Thus, the required amount of magnetization can be ensured without raising the magnetic characteristics per unit volume by making a difference in thickness between two-pole magnets, which are required to have a relatively high level of magnetic force, and four- and six-pole magnets, which are not required to have a high level of magnetic force, and increasing the thickness of moldings as the two-pole magnets to thereby increase the volume of the magnets, while the thickness of the four- and six-pole magnets is reduced to thereby reduce the volume of the magnets, thereby enabling the amount of magnetization to be controlled even more easily even at a low level of magnetic force. In addition, since the thickness of magnet moldings is from 40 to 70% of the thickness of those used in the prior art, it is possible to increase the number of magnet moldings which can be set on the magnetizing yoke per magnetizing process in which a plurality of magnet moldings are magnetized simultaneously in a bundle, so that the throughput in the magnetizing process increases 30 to 120%.

DETAILED DESCRIPTION OF PREFERRED EMBODIMENTS

The present invention will be described below in detail by way of one embodiment and with reference to the accompanying drawings.

Bonded magnet materials usable for magnets in the present invention will first be explained. As a binder, known synthetic resin materials are usable, for example, thermoplastic resins such as polyamide (nylon), polypropylene, polyester, acrylic resin, polycarbonate, polyphenylene ether, polyethylene terephthalate, polyphenylene sulfide, etc. These resin materials may be used alone or in the form of a mixture of two or more. As a magnetic powder, ferrites, for example, magnetoplumbite type Sr (strontium) ferrite, Ba (barium) ferrite, etc., or alnico magnet steel materials, may be employed. The magnetic powder content is preferably in the range of from 25 to 60% by volume. It is also possible to add additives which are usually employed, for example, a silane treating agent, a titanate treating agent, a plasticizer, etc. for enhancing the affinity between the magnetic powder and the binder and the fluidity.

It is also preferable to add a flame-retardant, for example, a halogen or antimony system flame-retardant, in order to endow the product with flame retardance. Addition of a flame-retardant enables the product to exhibit adequate flame retardance even if the thickness is 1.0 mm or less.

As a material for the holder and the spacers, an engineering plastic, for example, polyphenylene oxide, polypropylene, etc., may be used. In general, these resin materials are flame-retarded before actual use.

The present invention will be explained below more specifically by way of a specific example and a comparative exmaple. However, the present invention is in no way restricted by these examples.

Example

Figure 1:
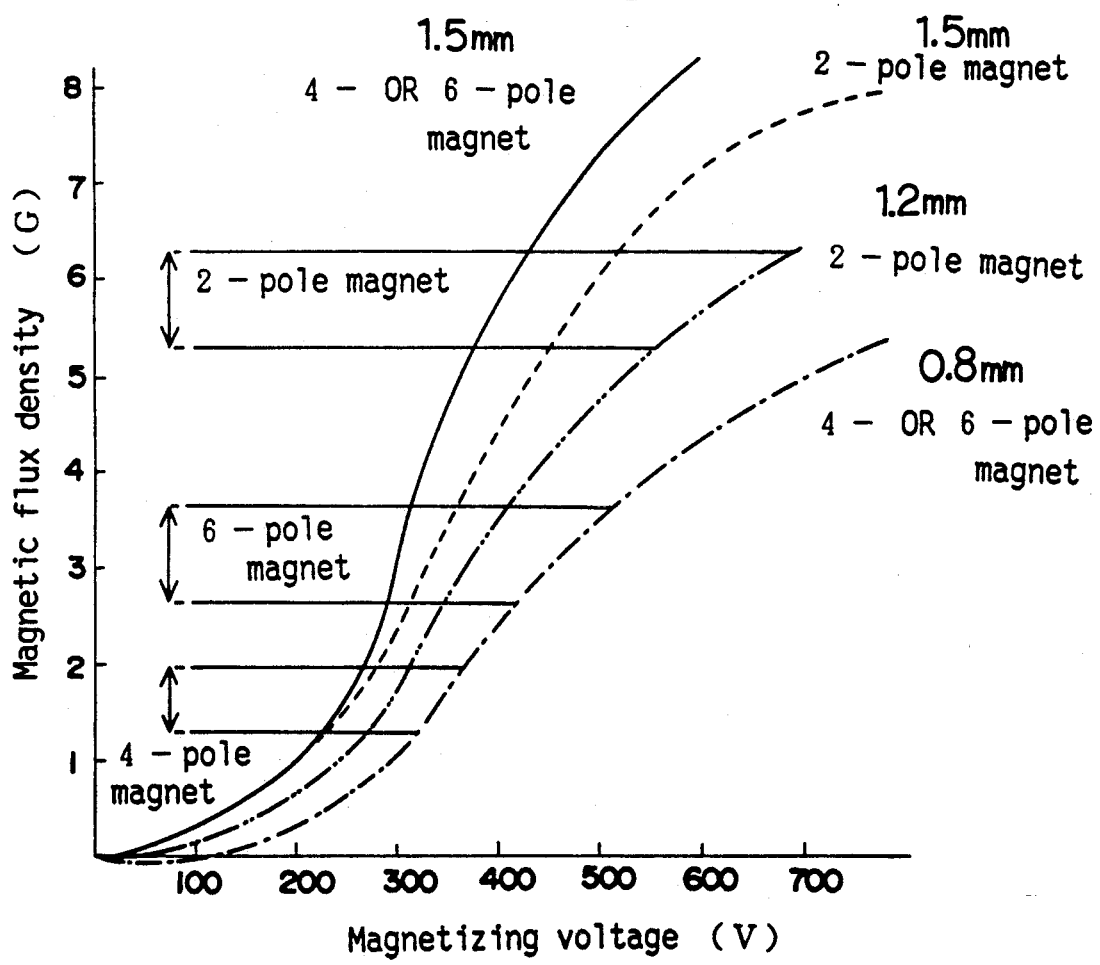
FIG. 1 is a graph showing the relationship between the amount of magnetization and the magnetizing voltage for each value of the magnet thickness.
Figure 2:
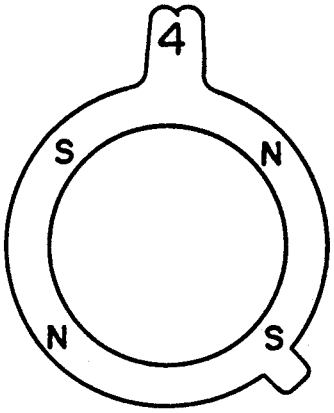
FIG. 2 illustrates the arrangement of magnetic poles of a four-pole magnet.
Figure 3:
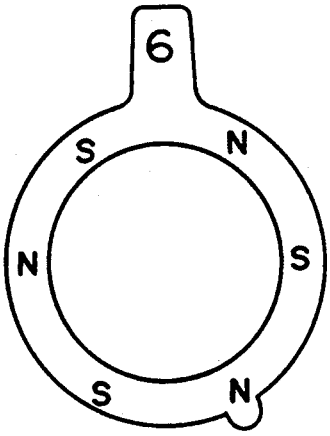
FIG. 3 illustrates the arrangement of magnetic poles of a six-pole magnet.
Figure 4:
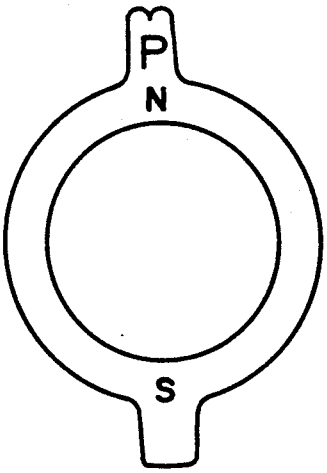
FIG. 4 illustrates the arrangement of magnetic poles of a two-pole magnet.
Figure 5:
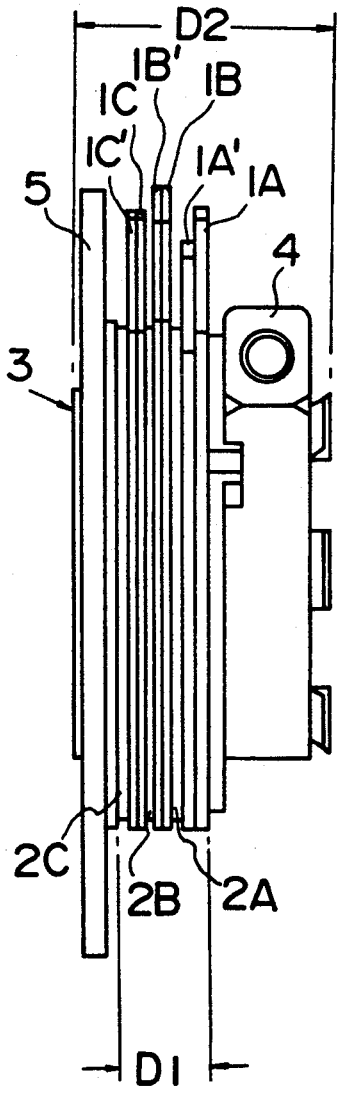
FIG. 5 illustrates one embodiment of the electron beam adjusting device according to the present invention.
Figure 6:
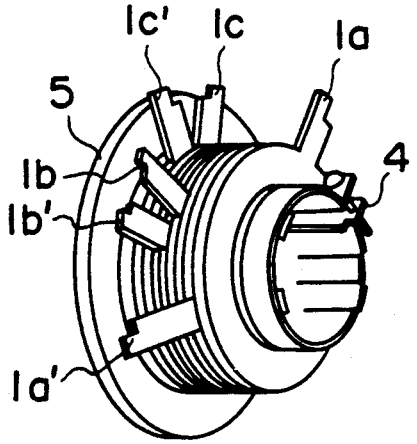
FIGS. 6 and 7 illustrate a conventional electron beam adjusting device.
Figure 7:
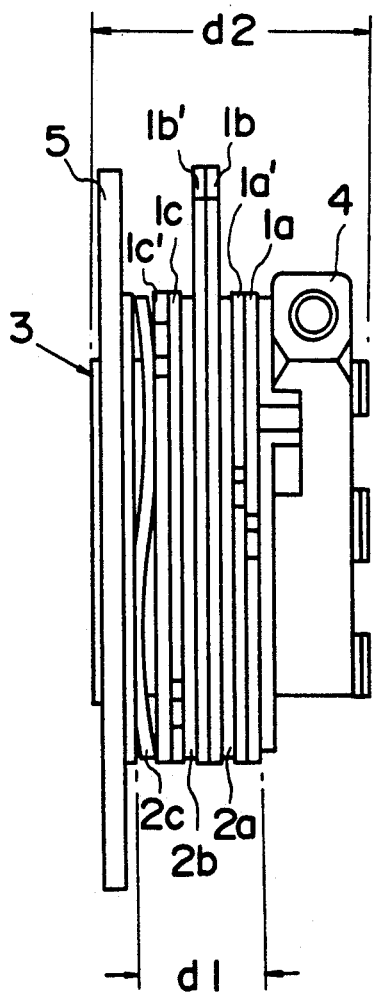

Ring-shaped magnetic moldings (not magnetized yet) having an inner diameter of 34 mm, an outer diameter of 45 mm and a thickness of 0.8 mm were made with an injection molding machine (manufactured by Sumitomo Ship Building and Machinery Co., Ltd.) with a mold clamping pressure of 100 tons, using a bonded magnet material "CPM-3 (manufactured by Kanegafuchi Chemical Industry Co., Ltd.)" comprising 35% by volume of barium ferrite and the balance of a polyamide resin material and a flame-retardant. The resulting magnet moldings were magnetized at predetermined positions thereof by use of a magnetizing power supply with a condenser capacitance of 500 μF at magnetizing voltages of 300 V and 480 V, thereby obtaining four- and six-pole magnets shown in FIGS. 2 and 3, respectively. Thereafter, the amount of magnetization, variations thereof, and the amount of beam shift were measured for each magnet. Table 1 below shows the results of the measurement. In addition, two-pole magnets shown in FIG. 4 were made separately from the above by magnetizing moldings of a magnetic material with a thickness of 1.2 mm. Then, as shown in FIG. 5, the two-pole magnets 1A and 1A', the four-pole magnets 1B and 1B', and the six-pole magnets 1C and 1C' were paired, respectively, and spacers 2A and 2B having an inner diameter of 34 mm, an outer diameter of 45 mm and a thickness of 0.8 mm were interposed respectively between the two-pole magnet 1A' and the four-pole magnet 1B and between the four-pole magnet 1B' and the six-pole magnets 1C. Thereafter, the group of magnets was mounted on a holder 3 made of a synthetic resin material (Norile N225: manufactured by Nippon GE Plastics) having an inner diameter of 30.4 mm, an outer diameter of 33.5 mm and an axial length of 23 mm, together with a resilient spacer 2C having a thickness of 1.3 mm, thereby forming an electron beam adjusting device. The thickness D1 of the magnet assembly formed by combining together the magnets and the spacers was not larger than 10 mm, and the overall thickness D2 of the electron beam adjusting device was not larger than 25 mm.

Comparative Example

With the same die and injection molding machine as those used in the above-described Example, magnetic material moldings (not magnetized yet) having an inner diameter of 34 mm, an outer diameter of 45 mm and a thickness of 1.5 mm were made, and these moldings were magnetized at predetermined positions thereof at magnetizing voltages of 250 V and 310 V, thereby obtaining four- and six-pole magnets. Thereafter, the amount of magnetization, variations thereof, and the amount of beam shift were measured for each magnet. Table 1 below shows the results of the measurement. Then, the four- and six-pole magnets were combined with two-pole magnets with a thickness of 1.5 mm, made separately, and spacers with a thickness of 1 mm, and thereafter, the group of magnets was mounted on a holder having an inner diameter of 30.4 mm, an outer diameter of 33.5 mm and an axial length of 27.2 mm, together with a resilient spacer having a thickness of 1.5 mm, thereby forming an electron beam adjusting device. The thickness of the magnet assembly formed by combining together the magnets and the spacers was more than 12 mm, and the overall thickness of the electron beam adjusting device was more than 27 mm.

As will be clear from the results shown in Table 1, in the product obtained according to the present invention, magnetic force variations of the four- and six-pole magnets can be reduced to less than ½ of those of the conventional product, obtained in Comparative Example, and hence the adjusting accuracy can be improved. In addition, it is possible to reduce the thickness of the magnet assembly comprising magnets and spacers and hence possible to reduce the overall size and weight of the electron beam adjusting device.

As has been described above, according to the present invention, the thickness of four- and six-pole magnets is made smaller than that of two-pole magnets, and it is therefore possible to avoid magnetization in a voltage region where the amount of magnetization is likely to vary when four- and six-pole magnets are magnetized, and hence possible to effect magnetization in a more stable region. Accordingly, it is possible to obtain four- and six-pole magnets which have minimal interpole magnetic force variations and which are improved in the minimum amount of beam shift. Thus, an electron beam adjusting device which facilitates delicate adjustment is obtained. In addition, since the four- and six-pole magnets are thin, it is possible to reduce the overall size and weight of the electron beam adjusting device, and the amount of magnetic powder and resin material used can also be reduced. It is therefore possible to lower the production cost of the electron beam adjusting device. Since the thickness of constituent magnets is reduced, it is possible to increase the number of magnet moldings which can be set on the magnetizing yoke per magnetizing process. Thus, the magnetizing process efficiency improves by a large margin.

TABLE 1

| | | Comparative Example (thickness: 1.5 mm) | Example of invention (thickness: 0.8 mm) |
|---|---|---|---|
| Average amount | 2-pole | 6.02 G | 6.93 G |
| of magnetization | 4-pole | 1.75 G | 1.71 G |
| (unit: gauss) | 6-pole | 3.25 G | 3.31 G |
| Variations in amount | 2-pole | 0.43 G | 0.42 G |
| of magnetization | 4-pole | 0.35 G | 0.17 G |
| (unit: gauss) | 6-pole | 0.42 G | 0.19 G |
| Maximum beam | 4-pole | 5.52 mm | 5.51 mm |
| shift quantity | 6-pole | 2.16 mm | 2.38 mm |
| Minimum beam | 4-pole | 0.19 mm | 0.11 mm |
| shift quantity | 6-pole | 0.14 mm | 0.08 mm |
| Thickness of magnet assemble | | 12.5 mm | 8.7 mm |
| Overall thickness of device | | 27.2 mm | 23.0 mm |

I claim:

1. An electron beam adjusting device, comprising:

pairs of two-pole, four-pole, and six-pole ring magnets, which are attached around a neck of a cathode-ray tube used in a television receiver or a display, wherein said two-pole, four-pole, and six-pole ring magnets are different in thickness from each other; and wherein the thickness of said four-pole and six-pole ring magnets is smaller than that of said two-pole ring magnets.

2. An electron beam adjusting device according to claim 1, wherein said ring magnets are flame-retarded bonded magnets with a thickness of from 0.6 mm to 1.3 mm, and wherein the overall thickness of all the magnets and spacers used is not larger than 10 mm, and the overall thickness of said device, including a holder, is not larger than 25 mm.

* * * * *